US008678863B2

(12) United States Patent
Nagata et al.

(10) Patent No.: US 8,678,863 B2
(45) Date of Patent: Mar. 25, 2014

(54) CONNECTOR AND ELECTRONIC DEVICE HAVING THE SAME

(75) Inventors: Takayuki Nagata, Yao (JP); Daisuke Sasaki, Yao (JP)

(73) Assignee: Hosiden Corporation, Yao-shi (JP)

( * ) Notice: Subject to any disclaimer, the term of this patent is extended or adjusted under 35 U.S.C. 154(b) by 5 days.

(21) Appl. No.: 13/598,858

(22) Filed: Aug. 30, 2012

(65) Prior Publication Data

US 2013/0065445 A1 Mar. 14, 2013

(30) Foreign Application Priority Data

Sep. 14, 2011 (JP) ..... 2011-201038

(51) Int. Cl.
*H01R 24/04* (2006.01)

(52) U.S. Cl.
USPC ..... 439/669; 439/606

(58) Field of Classification Search
USPC ..... 439/668, 669, 606
See application file for complete search history.

(56) References Cited

U.S. PATENT DOCUMENTS 4,002,399 A * 1/1977 Deitch et al. ..... 439/638
4,165,147 A * 8/1979 Buck ..... 439/188
4,659,167 A * 4/1987 Masuda ..... 439/668
6,093,058 A * 7/2000 Wu ..... 439/607.35
6,595,804 B2 * 7/2003 Nagata ..... 439/668
6,835,080 B1 * 12/2004 Chang ..... 439/188
6,869,315 B2 * 3/2005 Nakai et al. ..... 439/668
7,637,787 B2 * 12/2009 Chien et al. ..... 439/668
8,123,569 B2 * 2/2012 Little et al. ..... 439/669
D672,717 S * 12/2012 Nagata ..... D13/133
2011/0195611 A1 * 8/2011 Little et al. ..... 439/668
2013/0065445 A1 * 3/2013 Nagata et al. ..... 439/625

FOREIGN PATENT DOCUMENTS

JP 2004-87185 A1 3/2004

* cited by examiner

*Primary Examiner* — James Harvey
(74) *Attorney, Agent, or Firm* — Kratz, Quintos & Hanson, LLP

(57) ABSTRACT

The invention provides a connector including a body, a cover, a contact, and a molded portion. The body includes a connecting hole, and a housing hole or slit communicating with the connecting hole and being open to an outside of the body. The cover blocks the housing hole or slit of the body. The contact includes a fixed portion fixedly attached in the housing hole or slit of the body, a contact portion disposed in the connecting hole, and a connecting portion protruding from between the body and the cover to an outside of the body and the cover. The molded portion, formed of insulating resin, covers and blocks at least a boundary between the body and the cover, a boundary between the body and the connecting portion of the contact, and a boundary between the cover and the connecting portion of the contact.

11 Claims, 14 Drawing Sheets

CONNECTOR AND ELECTRONIC DEVICE HAVING THE SAME

The present application claims priority under 35 U.S.C. §119 of Japanese Patent Application No. 2011-201038 filed on Sep. 14, 2011, the disclosure of which is expressly incorporated by reference herein in its entity.

BACKGROUND OF THE INVENTION

1. Technical Field

The present invention relates to connectors and electronic devices provided with the connectors.

2. Background Art

There is known a connector as disclosed in JP Publication No. 2004-87185 serving as an earphone jack for use in portable terminals such as smartphones. The connector is provided with a cover fitting thereover to prevent water intrusion into the portable terminal through the connector.

SUMMARY OF INVENTION

Such a connector may allow water intrusion into the portable terminal when the portable terminal is inadvertently exposed to water in the state where the cover is not properly engaged with the connector.

In view of the above circumstances, the invention is devised to provide a waterproof connector and an electronic device provided with the connector.

A connector according to an aspect of the invention includes a body, a cover, a contact, and a molded portion. The body includes a connecting hole, and a housing hole or slit communicating with the connecting hole and being open to an outside of the body. The cover blocks the housing hole or slit of the body. The contact includes a fixed portion fixedly attached in the housing hole or slit of the body, a contact portion disposed in the connecting hole, and a connecting portion protruding from between the body and the cover to an outside of the body and the cover. The molded portion, formed of insulating resin, covers and blocks at least a boundary between the body and the cover, a boundary between the body and the connecting portion of the contact, and a boundary between the cover and the connecting portion of the contact.

In this aspect of the invention, the insulating resin molded portion covers the boundary between the body and the cover, the boundary between the body and the connecting portion of the contact, and the boundary between the cover and the connecting portion of the contact. Thus, the connector is thus capable of preventing water intrusion from between the cover and the body, between the body and the connecting portion of the contact, and between the cover and the connecting portion of the contact. Moreover, the connector can provide such waterproof property at low costs because the molded portion of the insulating resin can be manufactured by outsert molding or in a similar method.

The connecting hole may pass through the body in a first direction. The body may further include a first end in a second direction orthogonal to the first direction, a second end in the second direction on the opposite side from the first end, a first recess provided in the first end, the first recess having a bottom provided with the housing hole or slit, and a second recess provided in the second end. The cover may include a first blocking portion to block the connecting hole, and a second blocking portion housed in the first recess so as to block the housing hole or slit. The molded portion may include first, second and third molded portions. The first molded portion may cover the first blocking portion and bond the first blocking portion to the body. The first molded portion may include a first end in the second direction and a second end in the second direction on the opposite side from the first end. The second molded portion may be continuous with the first end of the first molded portion and filled in the first recess of the body. The second molded portion may cover the second blocking portion and bond the second blocking portion to the body. The third molded portion may be continuous with the second end of the first molded portion and filled in the second recess of the body.

In this aspect of the invention, the first molded portion covers the first blocking portion and bond the first blocking portion to the body; the second molded portion is filled in the first recess of the first end of the body to cover the second blocking portion and bond the second blocking portion to the body; and the third molded portion is filled in the second recess in the second end of the body. That is, the second and third molded portions are provided such as to hold the body in the second direction, this aspect of invention can improve the bonding strength of the molded portion to the cover and the body.

The body may further include a third end in a third direction orthogonal to the first and second directions, and a fourth end in the third direction on the opposite side from the third end. The first molded portion may further include a third end in the third direction, and a fourth end in the third direction on the opposite side from the third end. The molded portion may further include fourth and fifth molded portions. The fourth molded portion may be continuous with the third end of the first molded portion and cover the third end of the body. The fifth molded portion may be continuous with the fourth end of the first molded portion and cover the fourth end of the body.

In this aspect of the invention, the fourth molded portion communicating with the third end of the first molded portion covers the third end of the body, and the fifth molded portion communicating with the fourth end of the first molded portion covers the fourth end of the body. That is, since the fourth and fifth molded portions hold the body in the third direction, the bonding strength of the molded portion to the cover and the body can be improved.

One end surface in the third direction of the second blocking portion may be flush with an end surface of the third end of the body, and the fourth molded portion may bond the end surface of the second block portion to the end surface of the third end of the body. The other end surface in the third direction of the second blocking portion may be flush with an end surface of the fourth end of the body, and the fifth molded portion may bond the end surface of the second block portion to the end surface of the fourth end of the body.

The connecting portion of the contact may pass through the second, fourth or fifth molded portion. In this case, the second, fourth or fifth molded portion covers a boundary between the connecting portion of the contact and the body and a boundary between the connecting portion of the contact and the cover.

At least one of the body and the cover may be provided with a lead hole for interconnecting between the housing hole or slit and the outside of the body and the cover. The connecting portion of the contact may protrude through the lead hole to the outside of the body and the cover.

It is preferable at least one of the body, the cover and the molded portion be made of a polyamide resin. This aspect of the invention can improve waterproof property of the connector because polyamide resins generally exhibit favorably goods adhesion to other resin materials and metals. This aspect of the invention can also improve twisting strength of the connector because polyamide resins are superior to other resin materials in toughness.

The connector may further include a ring-shaped gasket to fit around the body. In this aspect of the invention, the ring-shaped gasket fitted around the body may be interposed between the connector and a housing of electronic device with the connector installed. Therefore, this aspect of the invention can prevent water intrusion from between the connector and the housing of the electronic device.

An electronic device of the invention includes the connector according one of the above-mentioned aspects described above.

DESCRIPTION OF EMBODIMENTS

Figure 1A:
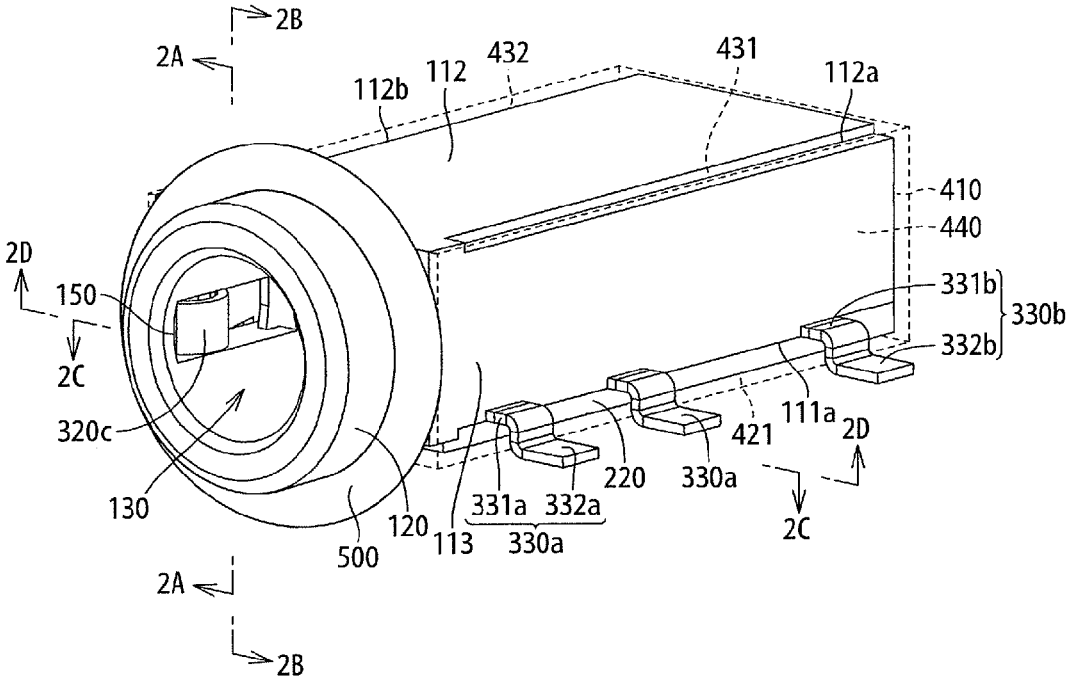
FIG. 1A is a front, top, right side perspective view of a connector in accordance with Embodiment 1 of the invention, illustrating a molded portion as transparent.

Embodiments 1 and 2 of the invention will be described below.

Embodiment 1

First, a connector in accordance with Embodiment 1 of the invention will be described with reference to FIG. 1A to FIG. 3B. The connector shown in FIG. 1A to FIG. 2B is a jack for mating with a plug (not shown). The connector includes a body 100, a cover 200, three contacts 300*a*, a contact 300*b*, a contact 300*c*, a molded portion 400, and a gasket 500. Each of these constituents of the connector will be described below in detail. It should be noted that FIG. 3A and FIG. 3B indicate X, Y, and Z directions, which are a width direction, a front-back direction, and a vertical direction, respectively, of the connector. The Y direction is orthogonal to the X direction, and the Z direction is orthogonal to the X and Y directions. The X, Y, and Z directions corresponds to a third direction, a first direction, and a second direction, respectively, in the claims, and the Y direction also corresponds to a longitudinal direction of the body 100 in the claims. The mating plug has a cylindrical connecting portion, around which a third electrode, a second electrode, a first electrode, and an earth electrode are formed in this order from a distal end side of the connecting portion.

The body 100 is made of an insulating resin such as a polyamide resin. The body 100 includes a main body 110 and a ring 120. The main body 110 is of a substantially rectangular parallelepiped shape as shown in FIG. 1A to FIG. 3B, including a first end 111 in the Z direction, a second end 112 in the Z direction on the opposite side from the first end 111, a third end 113 in the X direction, a fourth end 114 in the X direction on the opposite side from the third end 113, a fifth end 115 in the Y direction, and a sixth end 116 in the X direction on the opposite side from the fifth end 115. The ring 120 is a cylinder connected to the fifth end 115 of the main body 110. The gasket 500 made of a silicon resin is fitted around the ring 120. The gasket 500 may be interposed between the ring 120 and a housing (not shown) of electronic device for mounting the connector to prevent intrusion of water, dusts and the like from between the ring 120 and the housing. The gasket 500 may be omitted. The gasket may be fitted around the main body 110.

Figure 2A:
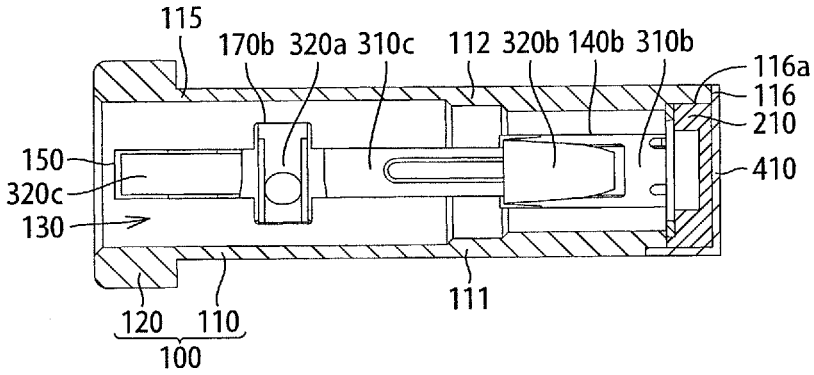
FIG. 2A is a sectional view of the connector taken along 2A-2A in FIG. 1A, with a gasket removed.
Figure 2B:
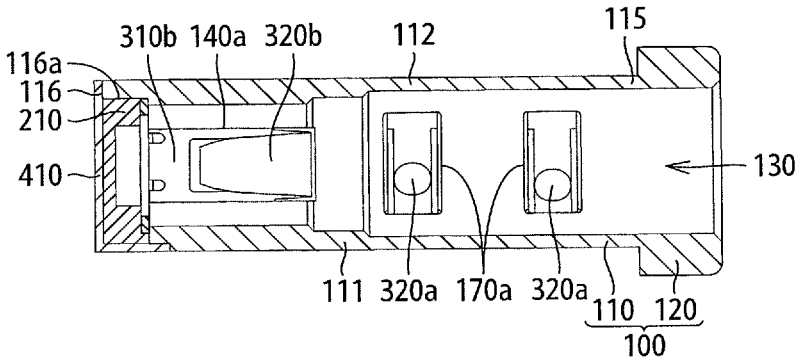
FIG. 2B is a sectional view of the connector taken along 2B-2B in FIG. 1A, with the gasket removed.
Figure 2C:
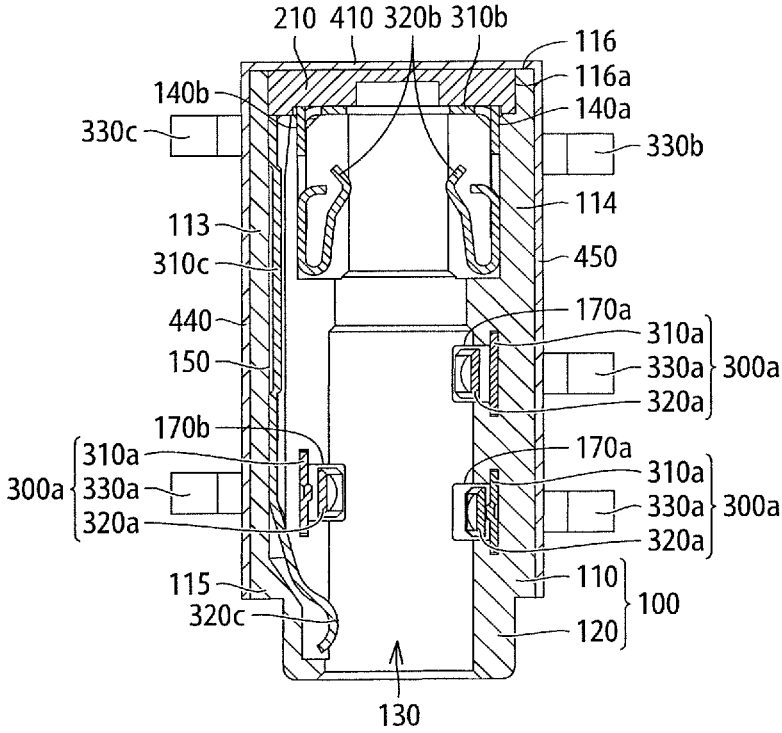
FIG. 2C is a sectional view of the connector taken along 2C-2C in FIG. 1A, with the gasket removed.
Figure 2D:
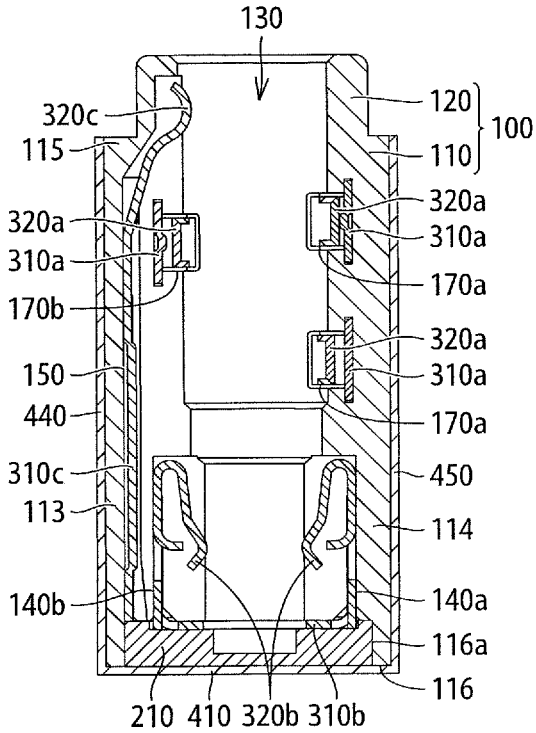
FIG. 2D is a sectional view of the connector taken along 2D-2D in FIG. 1A, with the gasket removed.

The body 100 is further provided with a connecting hole 130, slits 140*a* and 140*b*, a slit 150, a lead hole 160*a* and 160*b*, a pair of housing holes 170*a*, a housing hole 170*b*, a pair of lead holes 180*a*, a lead hole 180*b*. More particularly, the connecting hole 130 passes through the main body 110 and the ring 120 in the Y direction as shown in FIG. 2C and FIG. 2D. The slits 140*a*, 140*b* extend in the Y direction on opposite sides in the X direction of the connecting hole 130 of the main body 110. The slits 140*a*, 140*b* are open on the side of the connecting hole 130 and communicate with the connecting hole 130. The slit 150 extends in the Y direction on the outer side of the slit 140*b* of the main body 110. The slit 150 is open on the side of the connecting hole 130 and communicates with the slit 140*b* and the connecting hole 130. A housing recess 116*a* is formed in the sixth end 116 of the main body 110. The connecting hole 130, the slits 140*a*, 140*b* and the slit 150 are open on a side in the Y direction (i.e. on the rear side) to the outside of the body 100 through the housing recess 116*a*.

Figure 3A:
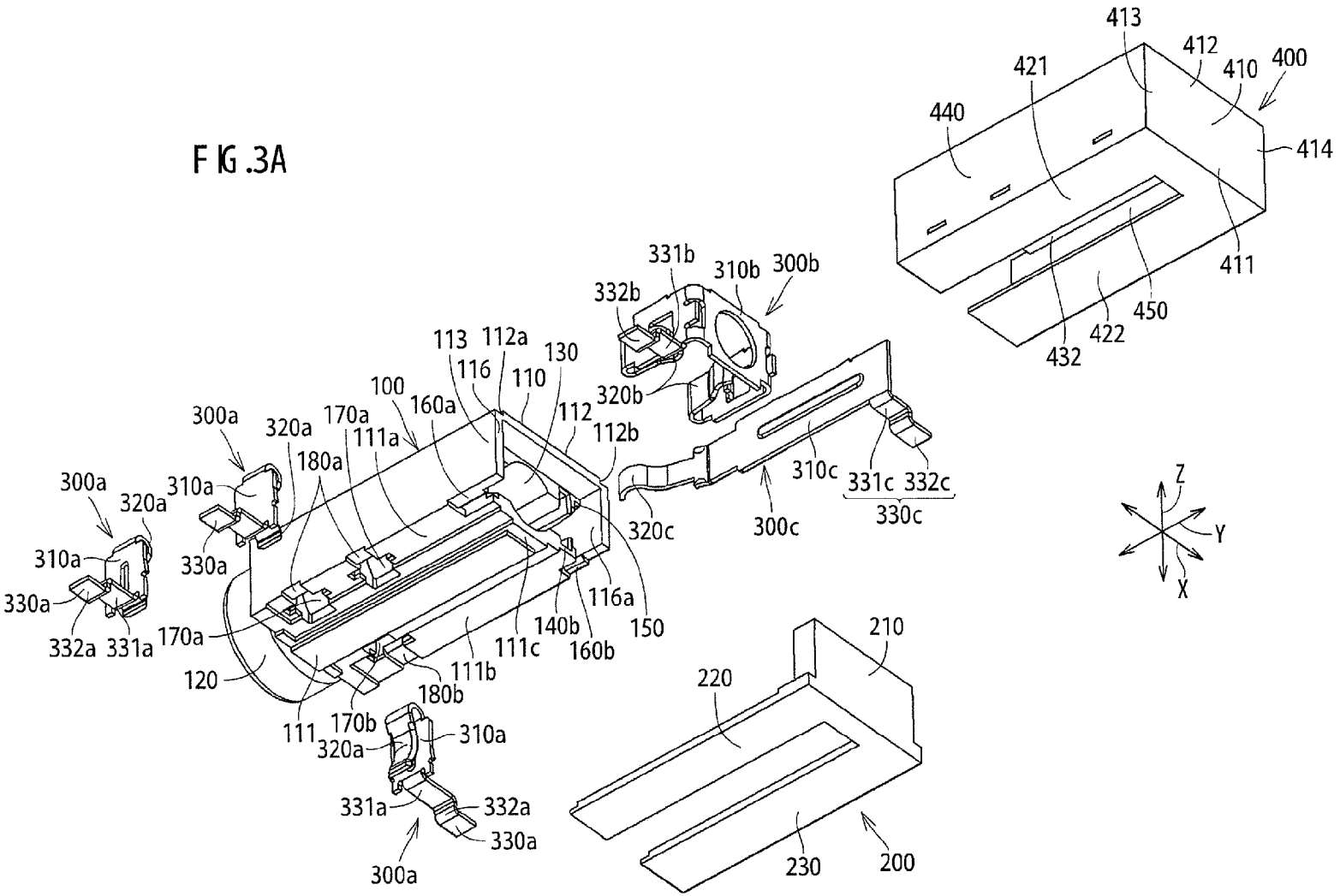
FIG. 3A is an exploded, back, bottom, right side perspective view of the connector.
Figure 3B:
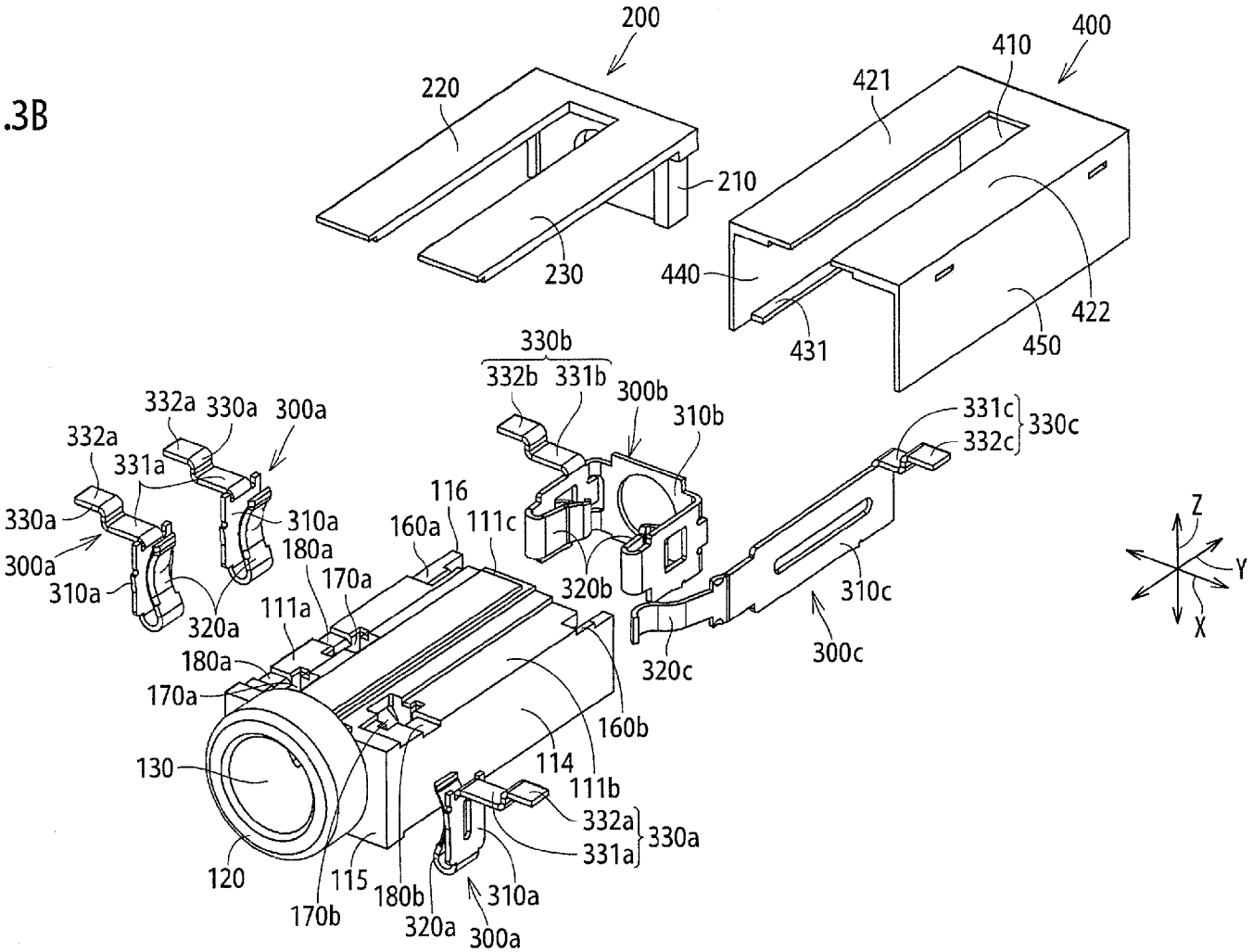
FIG. 3B is an exploded, front, bottom, left side perspective view of the connector.

As shown in FIG. 3A and FIG. 3B, first recesses 111*a*, 111*b* extend in the Y direction along opposite ends in the X direction of the first end 111 of the main body 110. The lead hole 160*a* is formed in the bottom of the first recess 111*a* and communicate with the slit 140*a*. The bottom of the first recess 111*a* is also provided with the pair of housing holes 170*a* aligning in the Y direction and the pair of lead holes 180*a* communicating with the respective housing holes 170*a*. The lead hole 160*a* is open on the side of the third end 113 of the main body 110 and interconnect between the slit 140*a* and the outside of the main body 110. The housing holes 170*a* is open on the other side (lower side) in the Z direction. The lead holes 180*a* are open on the side of the third end 113 of the main body 110 and interconnect between the housing holes 170*a* and the outside of the main body 110.

The lead hole 160*b* is formed in the bottom of the first recess 111*b* and communicate with the slit 140*b*. The bottom of the first recess 111*b* is also provided with the housing hole 170*b* and the lead hole 180*b* communicating with each other. The lead hole 160*b* is open on the side of the fourth end 114 of the main body 110 and interconnect between the slit 140*b* and the outside of the main body 110. The housing hole 170*b* is open on the other side (lower side) in the Z direction. The lead hole 180*b* is open on the side of the fourth end 114 of the main body 110 and interconnect between the housing hole 170*b* and the outside of the main body 110.

Figure 1B:
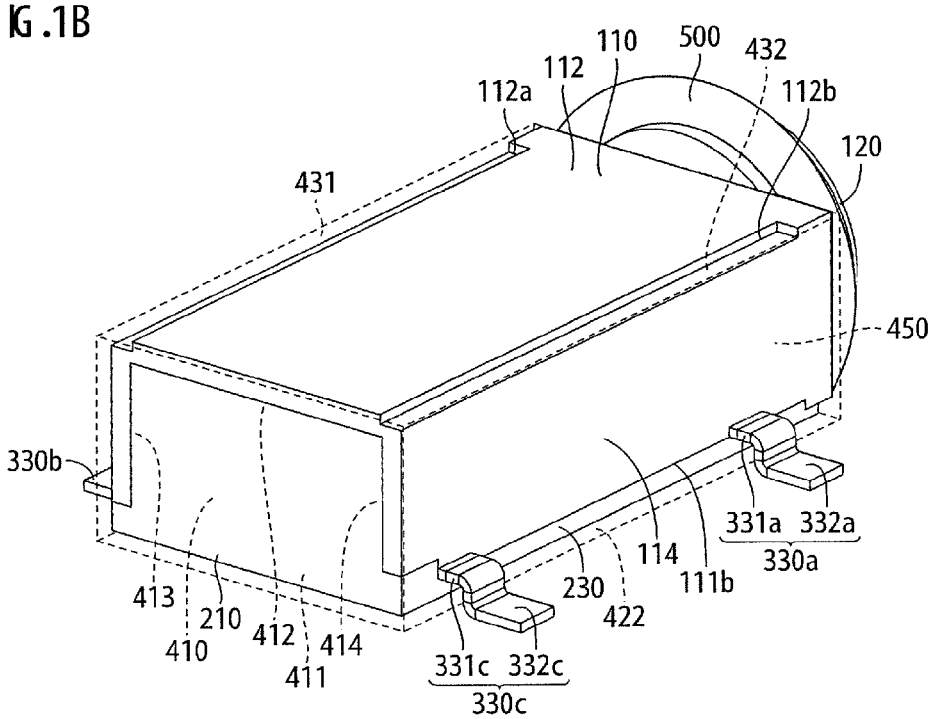
FIG. 1B is a back, top, left side perspective view of the connector, illustrating a molded portion as transparent.

The first end 111 of the main body 110 is provided on one end in the Y direction with a recess 111*c* communicating with the first recesses 111*a*, 111*b*. The second end 112 of the main body 110 is provided along opposite ends in the X direction with second recesses 112*a*, 112*b* extending in the Y direction, as shown in FIG. 1A and FIG. 1B The contacts 300*a* are formed of electrically conductive metal plates. The contacts 300*a* each includes a fixed portion 310*a*, a contact portion 320*a*, and a connecting portion 330*a*. The fixed portion 310*a* is a substantially rectangular plate and has a protrusion on each end in its width direction. The width of the fixed portion 310*a* including the protrusions is slightly larger than each width of the housing holes 170*a*, 170*b* of the body 100. Accordingly, the fixed portions 310*a* are fittingly held in the housing holes 170*a*, 170*b*, respectively. The contact portion 320*a* is a plate spring continuous with one end in the Z direction of the fixed portion 310*a* and is folded toward the other end in the Z direction. The contact portion 320*a* is accommodated in each of the housing holes 170*a*, 170*b*. When accommodated, the contact portion 320*a* is partly placed in the connecting hole 130 for elastic contact with the first and second electrodes of the plug. The connecting portion 330*a* is a plate continuous with the other end in the Z direction of the fixed portion 310*a* and bent substantially perpendicularly to the fixed portion 310*a*. The connecting portion 330*a* has a basal end 331*a* and a distal end 332*a* continuous with each other. The basal ends 331*a* pass through the lead holes 180*a*, 180*b* of the main body 110 and protrude toward the third end 113 and the fourth end 114 of the main body. The distal end 332*a* is formed step-like.

The contact 300*b* is a chip spring formed of an electrically conductive metal plate. The contact 300*b* includes a fixed portion 310*b*, a pair of contact portions 320*b*, and a connecting portion 330*b*. The fixed portion 310*b* is a generally U-shaped plate. The fixed portion 310*b* includes a first plate and a pair of second plates. The second plates are provided on opposite ends in the X direction of the first plate and bent substantially perpendicularly to the first plate. A protrusion is provided at one end in the Z direction of each of the second plates of the fixed portion 310*b*. The Z direction dimension of the fixed portion 310*b* including the protrusions is slightly larger than each Z direction dimension of the slits 140*a*, 140*b* of the body 100. Accordingly, the fixed portion 310*b* is fittingly held in the slits 140*a*, 140*b*. The first plate of the fixed portion 310*b* is disposed so as to block one side in the Y direction of the connecting hole 130 of the main body 110. The contact portions 320*b* are plate springs continuous with the distal end of the second plate of the fixed portion 310*b* and folded toward the rear side (one side in the Y direction). The distal ends of the contact portions 320*b* are received in the connecting hole 130 for elastic contact with the third electrode of the plug. The connecting portion 330*b* is a plate continuous with the other end in the Z direction of one of the second plates of the fixed portion 310*b* and bent substantially perpendicularly to the second plate. The connecting portion 330*b* has a basal end 331*b* and a distal end 332*b* continuous with each other. The basal end 331*b* pass through the lead hole 160*a* of the main body 110 and protrudes toward the third end 113 of the main body 110. The distal end 332*b* is formed step-like.

The contact 300*c* is an earth spring formed of an electrically conductive metal plate. The contact 300*c* includes a fixed portion 310*c*, a contact portion 320*c*, and a connecting portion 330*c*. The fixed portion 310*c* is a substantially rectangular plate extending in the Y direction and provided with a protrusion at its end in the Z direction. The Z direction dimension of the fixed portion 310*c* including the protrusion is slightly larger than the Z direction dimension of the slit 150 of the body 100. Accordingly, the fixed portion 310*c* is fittingly held in the slit 150. The contact portion 320*c* is a plate spring continuous with a distal end (the other end in the Y direction) of the fixed portion 310*c* and is curved inward. The distal end of the contact portion 320*c* is placed in the connecting hole 130 for elastic contact with the earth electrode of the plug. The connecting portion 330*c* is a plate continuous with the other end in the Y direction of the fixed portion 310*c* and bent substantially perpendicularly to the fixed portion 310*c*. The connecting portion 330*c* includes a basal end 331*c* and a distal end 332*c* continuous with each other. The basal end 331*c* passes through the lead hole 160*b* of the main body 110 and protrudes toward the fourth end 114 of the main body 110. The distal end 332*c* is formed step-like. The lower surfaces of the distal ends 332*a*, 332*b*, 332*c* are set to be in the same height level.

The cover 200 is made of an insulating resin such as a polyamide resin. The cover 200 includes a first blocking portion 210 and second blocking portions 220, 230. The first blocking portion 210 is a rectangular plate and is housed in the housing recess 116*a* of the body 100. The first blocking portion 210 blocks one side in the Y direction of each of the connecting hole 130 and the slits 140*a*, 140*b*, 150 and covers the fixed portions 310*b*, 310*c* and the contact portions 320*b*, 320*c* of the contacts 300*b*, 300*c*.

Figure 1C:
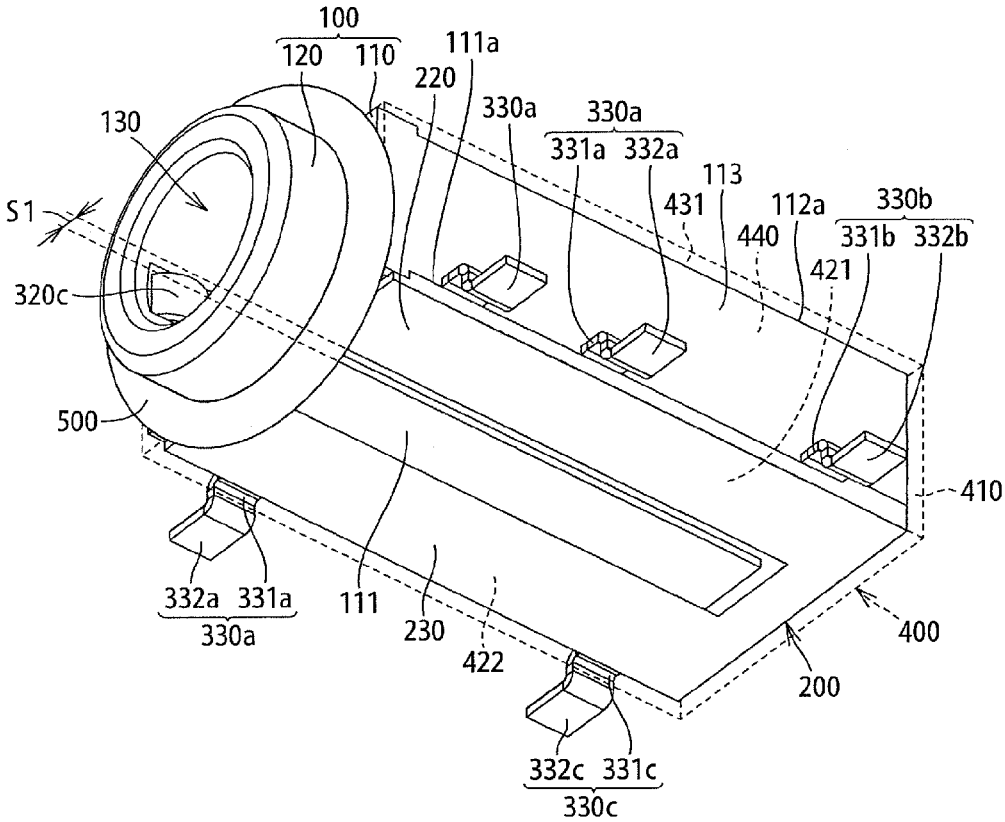
FIG. 1C is a front, bottom, right side perspective view of the connector, illustrating the molded portion as transparent.

The second blocking portions 220, 230 are generally rectangular plates continuous with the lower end (the other end in the Z direction) of the first blocking portion 110 and extend in the Y direction. The second blocking portions 220, 230 has an integrated basal end. The second blocking portion 220 fits in the first recess 111*a* of the main body 110 so as to block the lead hole 160*a*, the housing holes 170*a* and the lead holes 180*a* and cover the fixed portions 310*a* and the contact portions 320*a* of the contacts 300*a* in the housing holes 170*a*. One end surface in the X direction of the second blocking portion 220 is flush with the end surface of the third end 113 of the main body 110. As shown in FIG. 1C, a gap S1 is provided between the other end face in the X direction of the second blocking portion 220 and the inner wall on the other side in the X direction of the first recess 111*a* of the main body 110.

Figure 1D:
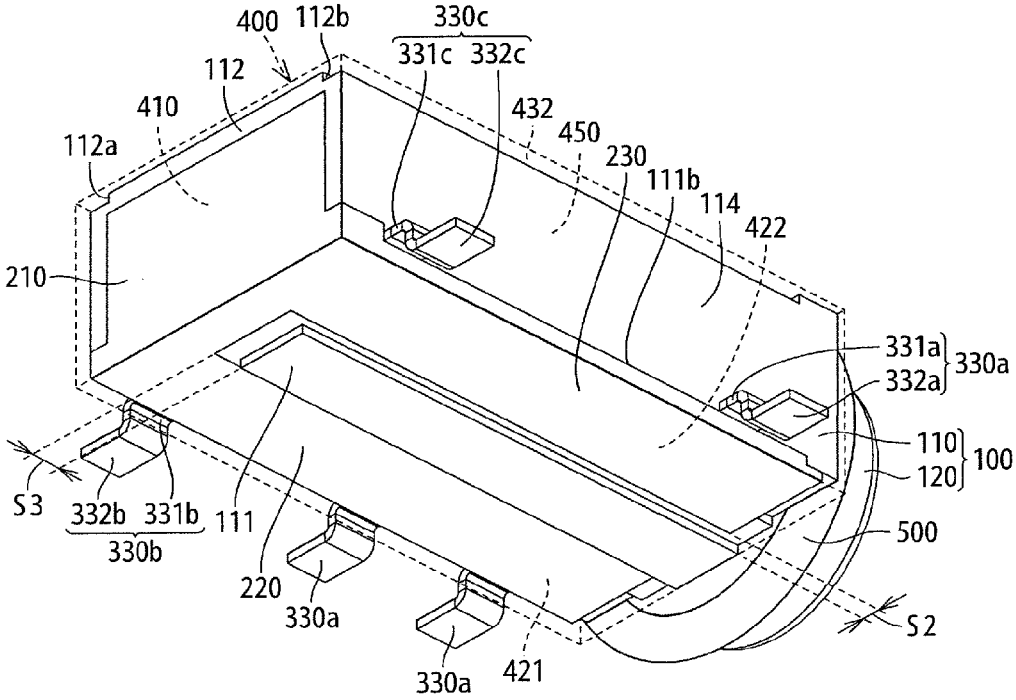
FIG. 1D is a back, bottom, left side perspective view of the connector, illustrating the molded portion as transparent.

The second blocking portion 230 fits in the first recess 111*b* of the main body 110 so as to block the lead hole 160*b*, the housing hole 170*b* and the lead hole 180*b* and cover the fixed portion 310*a* and the contact portion 320*a* of the contact 300*a* in the housing hole 170*b*. The other end surface in the X direction of the second blocking portion 230 is flush with the end surface of the fourth end 114 of the main body 110. As shown in FIG. 1D, a gap S2 is provided between the one end surface in the X direction of the second blocking portion 230 and the inner wall on the one side in the X direction of the first recess 111*b* of the main body 110. As shown in FIG. 1D, a gap S3 is provided between the integrated basal end of the second blocking portions 220, 230 and the inner wall on other side in the Y direction of the recess 111*c* of the main body 110.

The molded portion 400 is formed by outsert molding an insulating resin such as a polyamide resin. The molded portion 400 includes a first molded portion 410, second molded portions 421, 422, third molded portions 431, 432, a fourth molded portion 440, and a fifth molded portion 450.

The first molded portion 410 is a rectangular plate, contacting and covering the sixth end 116 of the main body 110 and the first blocking portion 210 of the cover 200 and bonding the first blocking portion 210 to the sixth end 116 of the main body 110. That is, the first molded portion 410 covers and blocks a boundary between the sixth end 116 of the main body 110 and the first blocking portion 210 of the cover 200. The first molded portion 410 includes a first end 411 in the Z direction, a second end 412 in the Z direction on the opposite side from the first end 411, a third end 413 in the X direction, and a fourth end 414 in the X direction on the opposite side from the third end 413.

The second molded portions 421, 422 are rectangular plates continuous with the first end 411 of the first molded portion 410 and extend in the Y direction. The second molded portions 421, 422 are filled into the gaps S1, S2 of the first recesses 111*a*, 111*b* of the first end 111 of the main body 110 and the gap S3 of the recess 111*c*, contact and cover the second blocking portions 220, 230, and bond the second blocking portions 220, 230 to the main body 110. That is, the second molded portions 421, 422 cover and block boundaries between the second blocking portions 220, 230 and the first end 111 of the main body 110.

The third molded portions 431, 432 are rectangular plates continuous with the second end 412 of the first molded portion 410 and extend in the Y direction. The third molded portions 431, 432 are filled into the second recesses 112*a*, 112*b* of the main body 110.

The fourth molded portion 440 is a rectangular plate continuous with the third end 413 of the first molded portion 410 and extends in the Y direction. The fourth molded portion 440 interconnects between the second molded portion 421 and the third molded portion 431. The fourth molded portion 440 contacts and covers the third end 113 of the main body 110 and one side in the X direction of the second blocking portion 220 and bonds one end surface in the X direction of the second blocking portion 220 to the end surface of the third end 113 of the main body 110. The basal ends 331*a* of the connecting portions 330*a* of the two contacts 300*a* on one side in the X direction, and the basal end 331*b* of the connecting portion 330*b* of the contact 300*b* pass through the fourth molded portion 440. That is, the fourth molded portion 440 covers and blocks a boundary between the second blocking portion 220 and the third end 113 of the main body 110, boundaries between the basal ends 331*a* of the connecting portions 330*a* of the two contacts 300*a* and the second blocking portion 220, the boundaries between the basal ends 331*a* of the connecting portions 330*a* of the contacts 300*a* and the third end 113 of the main body 110, a boundary between the basal end 331*b* of the connecting portion 330*b* of the contact 300*b* and the second blocking portion 220, and a boundary between the basal end 331*b* of the connecting portion 330*b* of the contact 300*b* and the third end 113 of the main body 110.

The fifth molded portion 450 is a rectangular plate continuous with the fourth end 414 of the first molded portion 410 and extends in the Y direction. The fifth molded portion 450 interconnects between the second molded portion 422 and the third molded portion 432. The fifth molded portion 450 contacts and covers the fourth end 114 of the main body 110 and the other side in the X direction of the second blocking portion 230, and bonds the other end surface in the X direction of the second blocking portion 230 to the end surface of the fourth end 114 of the main body 110. The basal end 331*a* of the connecting portion 330*a* of the one contact 300*a* on the other side in the X direction and the basal end 331*c* of the connecting portion 330*c* of the contact 300*c* pass through the fifth molded portion 450. That is, the fifth molded portion 450 covers and blocks a boundary between the second blocking portion 230 and the fourth end 114 of the main body 110, a boundary between the basal end 331*a* of the connecting portion 330*a* of the one contact 300*a* and the second blocking portion 230, a boundary between the basal end 331*a* of the connecting portion 330*a* of the one contact 300*a* and the fourth end 114 of the main body 110, a boundary between the basal end 331*c* of the connecting portion 330*c* of the contact 300*c* and the second blocking portion 230, a boundary between the basal end 331*c* of the connecting portion 330*c* of the contact 300*c* and the fourth end 114 of the main body 110.

The connector with the above-mentioned configuration may be manufactured in the following steps. The first step is to prepare the body 100 fabricated by injection-molding insulating resin, and the contact 300*a* fabricated by press-molding a metal plate. After that, the fixed portions 310*a* of the contacts 300*a* are pressed into the housing holes 170*a*, 170*b* of the body 100, and the contact portions 320*a* of the contacts 300*a* are inserted into the housing holes 170*a*, 170*b*. Then, the fixed portions 310*a* are held in the housing holes 170*a*, 170*b* of the body 100. The contact portions 320*a* are placed through the housing holes and then into the connecting hole 130 of the body 100 170*a*, 170*b*. The basal ends 331*a* of the connecting portions 330*a* of the contact 300*a* are inserted into the lead holes 180*a*, 180*b* of the body 100, and the distal ends 332*a* protrudes from the lead holes 180*a*, 180*b* to the outside of the body 100.

The next step is to prepare the contact 300*c* by press-molding a metal plate. The contact portion 320*c* of the contact 300*c* is inserted into the slit 150 of the body 100, and the fixed portion 310*c* is pressed into the slit 150. Then, the fixed portion 310*c* is held in the slit 150. The distal end of the contact portion 320*c* is placed through the slit 150 and then into the connecting hole 130. The basal end 331*c* of the connecting portion 330*c* of the contact 300*c* is inserted into the lead hole 160*b* of the body 100, and the distal end 332*c* protrudes from the lead hole 160*b* to the outside of the body 100.

The next step is to prepare the contact 300*b* by press-molding the metal plate. The pair of second plates of the fixed portion 310*b* of the contact 300*b* are pressed into the slits 140*a*, 140*b* of the body 100. Then, distal ends of the pair of contact portions 320*b* of the contact 300*b* are placed through the slits 140*a*, 140*b* and then into the connecting hole 130. The basal end 331*b* of the connecting portion 330*b* of the contact 300*b* is inserted into the lead hole 160*a* of the body 100, and the distal end 332*b* protrudes from the lead hole 160*a* to the outside of the body 100.

The next step is to prepare the cover 200 by injection-molding the insulating resin. The first blocking portion 210 of the cover 200 is fitted in the housing recess 116*a* of the body 100, and the second blocking portions 220, 230 of the cover 200 are fitted into the first recesses 111*a*, 111*b* of the body 100. Then, the first blocking portion 210 blocks the connecting hole 130, the slits 140*a*, 140*b* and the slit 150 of the body 100 and covers the contacts 300*b*, 300*c*. The second blocking portion 220 blocks the lead hole 160*a*, the housing holes 170*a* and the lead holes 180*a* and covers the contacts 300*a* in the housing hole 170*a*. The second blocking portion 230 blocks the lead hole 160*b*, the housing hole 170*b* and the lead hole

180*b* and covers the contact 300*a* in the housing hole 170*b*. In this state, the connecting portions 330*a* of the contacts 300*a* protrude from between the body 100 and the second blocking portions 220, 230 of the cover 200 to the outside. The connecting portion 330*b* of the contact 300*b* protrudes from between the body 100 and the second blocking portion 220 of the cover 200 to the outside. The connecting portion 330*c* of the contact 300*c* protrudes from between the body 100 and the second blocking portion 230 of the cover 200 to the outside. At this time, the outer surface of the first blocking portion 210 is flush with the end surface of the sixth end 116 of the body 100, the one end surface in the X direction of the second blocking portion 220 is flush with the end surface of the third end 113 of the main body 110, and the other end surface in the X direction of the second blocking portion 230 is flush with the end surface of the fourth end 114 of the main body 110. Also, the gap S1 is formed between the other end surface in the X direction of the second blocking portion 220 and the inner wall on the other side in the X direction of the first recess 111*a* of the main body 110. The gap S2 is formed between the one end surface in the X direction of the second blocking portion 230 and the inner wall on the one side in the X direction of the first recess 111*b* of the main body 110. The gap S3 is formed between the basal ends of the second blocking portions 220, 230 and the inner wall on the other side in the Y direction of the recess 111*c* of the main body 110.

The body 100, the contacts 300*a* to 300*c* and the cover 200 may be thus combined and then placed in a mold (not shown), and the insulating resin is poured into the mold for outsert molding. The insulating resin is outsert-molded into the molded portion 400. Then, the first molded portion 410 of the molded portion 400 covers the first blocking portion 210 of the cover 200 and the sixth end 116 of the body 100 and bonds the first blocking portion 210 to the sixth end 116 of the body 100. The second molded portions 421, 422 are filled into the first recesses 111*a*, 111*b* and the recess 111*c* of the main body 110, cover the second blocking portions 220, 230, and bond the second blocking portions 220, 230 to the first end 111 of the body 100. The third molded portions 431, 432 are filled into the second recesses 112*a*, 112*b* of the main body 110. The fourth molded portion 440 covers the third end 113 of the body 100 and the one side in the X direction of the second blocking portion 220, bonds the one end surface in the X direction of the second blocking portion 220 to the end surface of the third end 113 of the body 100. The fifth molded portion 450 covers the fourth end 114 of the body 100 and the other side in the X direction of the second blocking portion 230, and bonds the other end surface in the X direction of the second blocking portion 230 to the end surface of the fourth end 114 of the body 100. The connecting portions 330*a*, 330*b*, 330*c* of the contacts 300*a*, 300*b*, 300*c* pass through the fourth and fifth molded portions 440, 450, so that the distal ends 332*a*, 332*b*, 332*c* of the connecting portions 330*a*, 330*b*, 330*c* are placed outside of the fourth and fifth molded portions 440, 450.

The connector may be thus assembled and mounted on a circuit board of the electronic device in the following steps. First, the connector is placed on the circuit board. At this time, the distal ends 332*a* of the connecting portions 330*a* of the contacts 300*a* are each brought into contact with an electrode on the circuit board. The distal end 332*b* of the connecting portion 330*b* of the contact 300*b* is brought into contact with another electrode on the circuit board. The distal end 332*c* of the connecting portion 330*c* of the contact 300*c* is brought into contact with an earth electrode on the circuit board. After that, the distal ends 332*a* of the connecting portions 330*a* of the contacts 300*a* are soldered to the electrodes on the circuit board. The distal end 332*b* of the connecting portion 330*b* of the contact 300*b* is soldered to the another electrode on the circuit board. The distal end 332*c* of the connecting portion 330*c* of the contact 300*c* is soldered to the earth electrode on the circuit board.

The connector may be connected to a plug in the following steps. First, the plug is inserted into the connecting hole 130 of the connector. Then, the third electrode of the plug is elastically held between the contact portions 320*b* of the contact 300*b*. The second electrode of the plug elastically contacts the contact portion 320*a* of one of the three contacts 300*a*. The first electrode of the plug is held between the contact portions 320*a* of the remaining two contacts 300*a*. The earth electrode of the plug elastically contacts the contact portion 320*b* of the contact 300*b*.

The above-described connector has many advantageous features. First, the first molded portion 410 covers and blocks the boundary between the sixth end 116 of the main body 110 and the first blocking portion 210 of the cover 200. The second molded portions 421, 422 cover and block the boundaries between the second blocking portions 220, 230 and the first end 111 of the main body 110. The fourth molded portion 440 covers and blocks the boundary between the second blocking portion 220 and the third end 113 of the main body 110, the boundaries between the connecting portions 330*a* of the contacts 300*a* and the second blocking portion 220, the boundaries between the connecting portions 330*a* of the contacts 300*a* and the third end 113 of the main body 110, the boundary between the connecting portion 330*b* of the contact 300*b* and the second blocking portion 220, and the boundary between the connecting portion 330*b* of the contact 300*b* and the third end 113 of the main body 110. The fifth molded portion 450 covers and blocks the boundary between the second blocking portion 230 and the fourth end 114 of the main body 110, the boundary between the connecting portion 330*a* of the one contact 300*a* on the other side in the X direction and the second blocking portion 230, the boundary between the connecting portion 330*a* of the one contact 300*a* and the fourth end 114 of the main body 110, the boundary between the connecting portion 330*c* of the contact 300*c* and the second blocking portion 230, and the boundary between the connecting portion 330*c* of the contact 300*c* and the fourth end 114 of the main body 110. The connector is thus capable of preventing water intrusion from between the cover 200 and the body 100, between the body 100 and the connecting portions 330*a*, 330*b*, 330*c* of the contacts 300*a*, 300*b*, 300*c*, and between the cover 200 and the connecting portion 330*a*, 330*b*, 330*c* of the contacts 300*a*, 300*b*, 300*c*. Moreover, the connector can provide such waterproof property at low costs because the first molded portion 410, the second molded portions 421, 422, and the fourth and fifth molded portions 440, 450 are manufactured by outsert molding or in a similar method.

Further advantageously, the second molded portions 421, 422 are filled in the first recesses 111*a*, 111*b* and the recess 111*c* of the main body 110 to cover the second blocking portions 220, 230, and the third molded portions 431, 432 are filled in the second recesses 112*a*, 112*b* of the main body 110. Similarly, the fourth molded portion 440 covers the third end 113 of the body 100 and the one side in the X direction of the second blocking portion 220, and the fifth molded portion 450 covers the fourth end 114 of the body 100 and the other side in the X direction of the second blocking portion 230. In other words, the second molded portions 421, 422 and the third molded portions 431, 432 as provided such as to hold the body 100 and the cover 200 therebetween in the Z direction and the fourth and fifth molded portions 440, 450 hold the body 100 and the cover 200 therebetween in the X direction. As a result, the molded portion 400 provides an advantageously high bonding strength with respect to the cover 200 and the body 100.

Embodiment 2

Next, a connector in accordance with Embodiment 2 of the invention will be described with reference to FIG. 4A to FIG. 6B. The connector shown in FIG. 4A to FIG. 5B is different from the connector in Embodiment 1 in that it is a mid-mount type connector to fit in a recess or a hole in a circuit board and be connected to the circuit board in this state. Specifically, to conform to the mid-mount type, the connector is different from the connector in Embodiment 1 in shape of a main body 110' of a body 100', a cover 200', connecting portions 330*a'* to 330*c'* of contacts 300*a'* to 300*c'* and a molded portion 400'. Only these differences from Embodiment 1 will be described below in detail, and the overlaps will be omitted. As described above, a symbol _'_ is added to reference numerals referring to the body, the cover, the contacts and the molded portion of this connector to distinguish them from the body, the cover, the contacts and the molded portion of the connector of Embodiment 1.

The body 100' has substantially the same configuration as the body 100 except for the following two points. The first difference is that an end surface of a third end 113' of the main body 110' is provided with a plurality of protrusions 113*a'* and grooves 113*b'*, and an end surface of the fourth end 114' is provided with a plurality of protrusions 114*a'* and grooves 114*b'*. The protrusions 113*a'*, 114*a'* are arranged in the Y direction with spacing therebetween. The grooves 113*b'*, 114*b'* extend in the Z direction. The second difference is that first recesses 111*a'*, 111*b'* of a first end 111' each has a region on the one end side in the Y direction that is narrower than the other region. FIG. 4A to FIG. 6B also illustrate a second end 112' of the main body, second recesses 112*a'*, 112*b'* of the second end, a fifth end 115' of the main body, a sixth end 116' of the main body, a housing recess 116*a'*, a ring 120', a connecting hole 130', slits 140*a'*, 140*b'*, 150', lead holes 160*a'*, 160*b'*, housing holes 170*a'*, 170*b'*, and lead holes 180*a'*, 180*b'*.

Figure 4A:
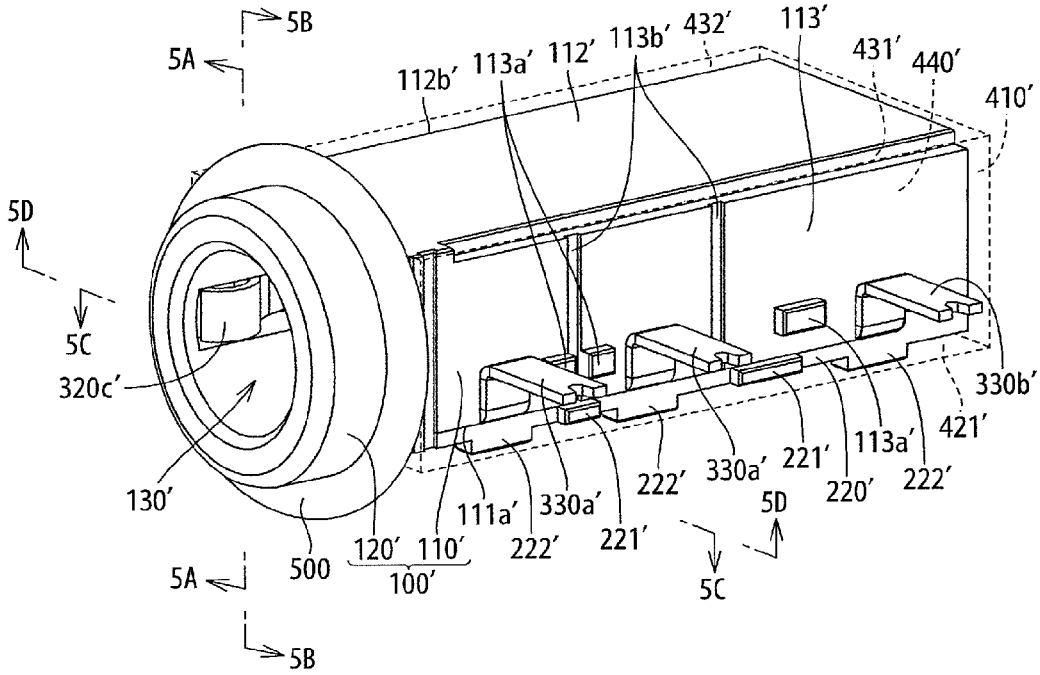
FIG. 4A is a front, top, right side perspective view of a connector in accordance with Embodiment 2 of the invention, illustrating a molded portion as transparent.
Figure 4B:
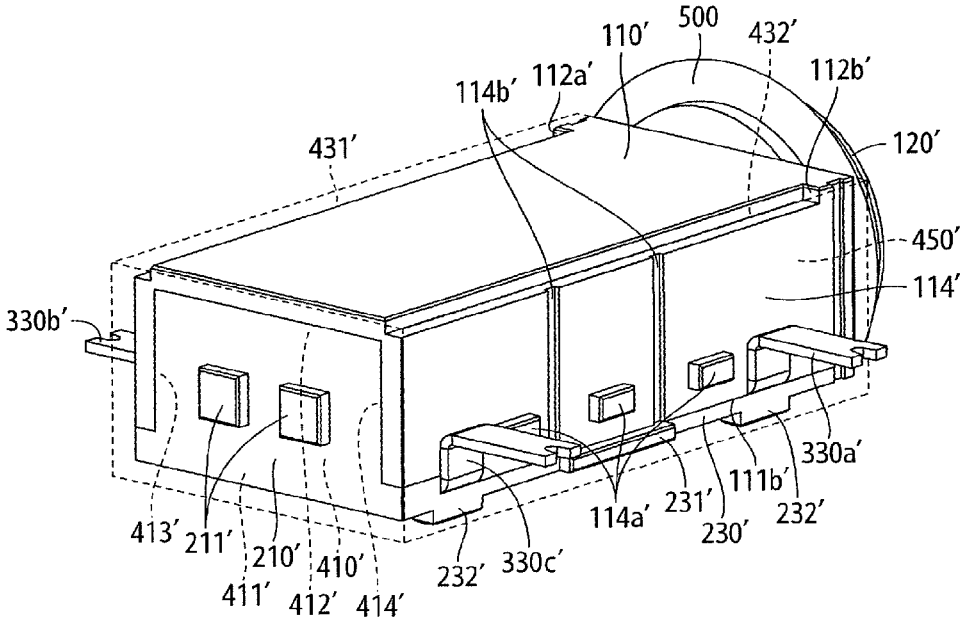
FIG. 4B is a back, top, left side perspective view of the connector, illustrating the molded portion as transparent.
Figure 4C:
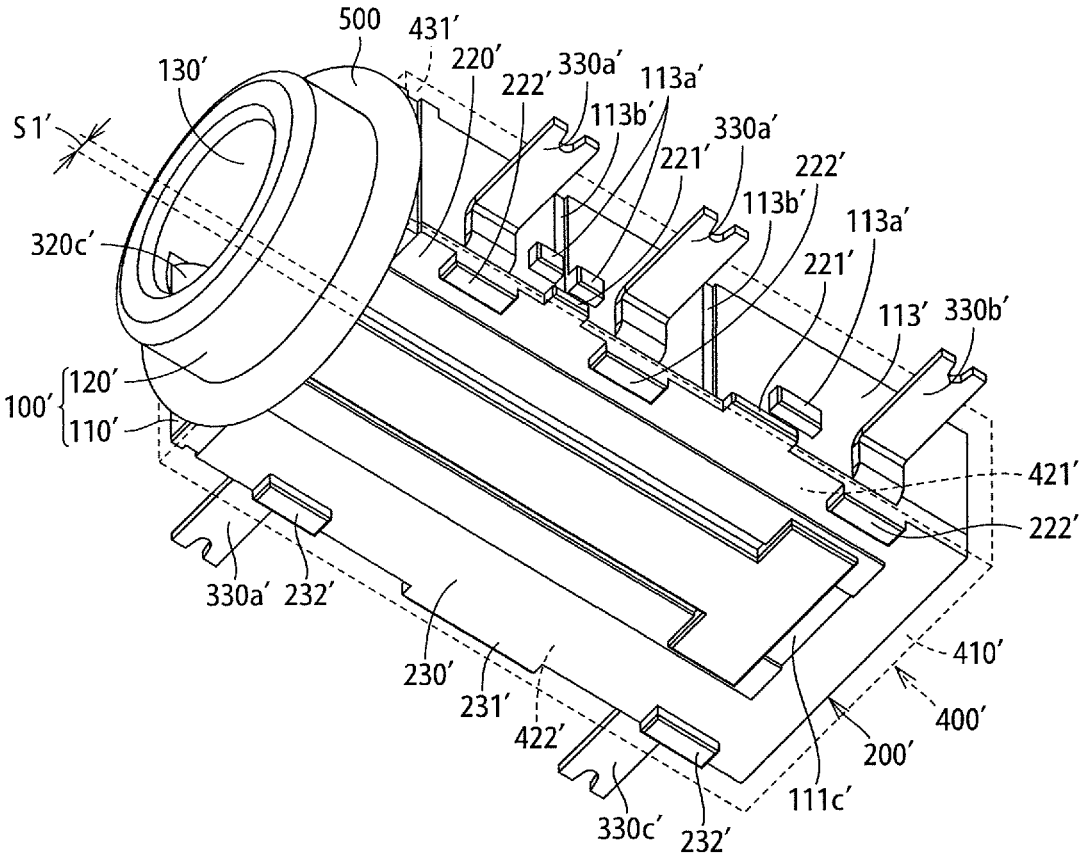
FIG. 4C is a front, bottom, right side perspective view of the connector, illustrating the molded portion as transparent.
Figure 4D:
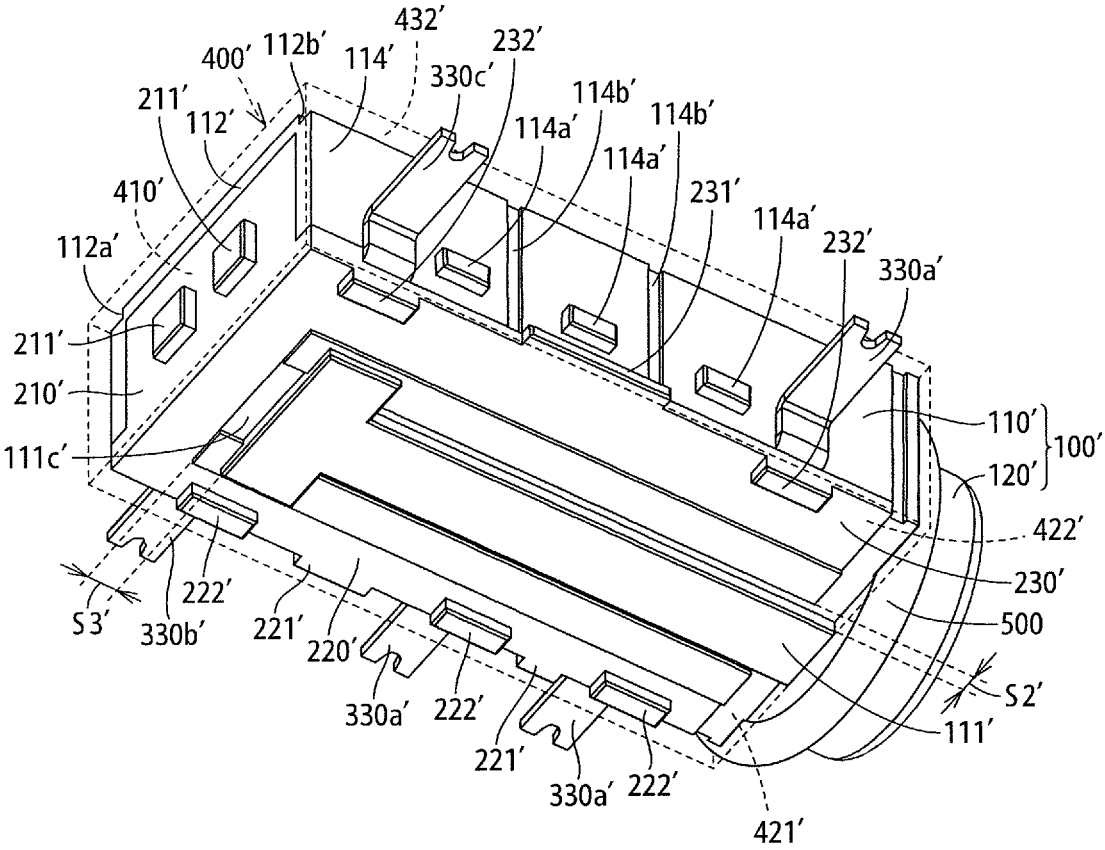
FIG. 4D is a back, bottom, left side perspective view of the connector, illustrating the molded portion as transparent.
Figure 5A:
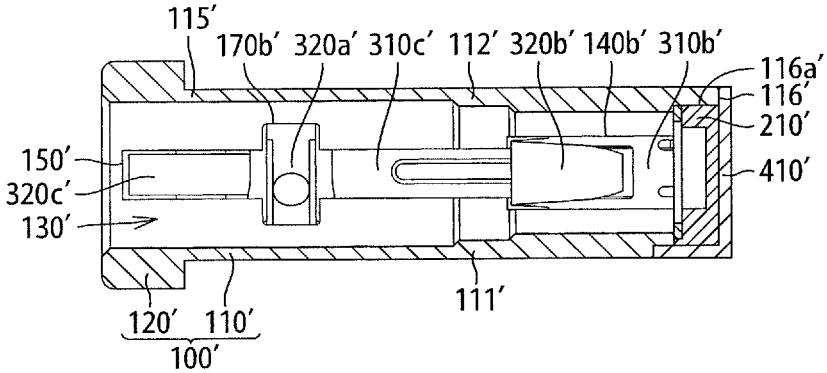
FIG. 5A is a sectional view of the connector taken along 5A-5A in FIG. 4A, with a gasket removed.
Figure 5B:
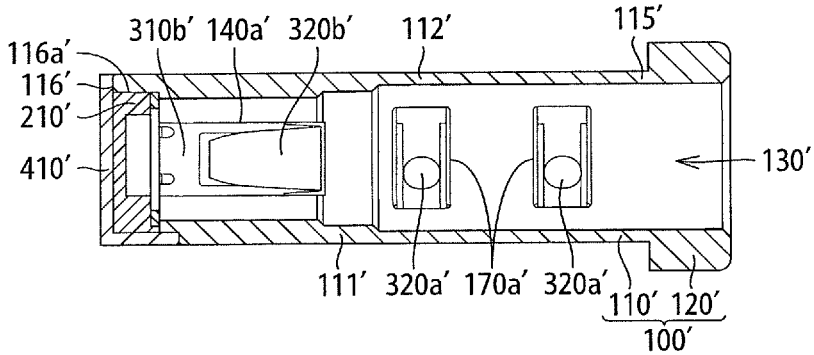
FIG. 5B is a sectional view of the connector taken along 5B-5B in FIG. 4A, with the gasket removed.
Figure 5C:
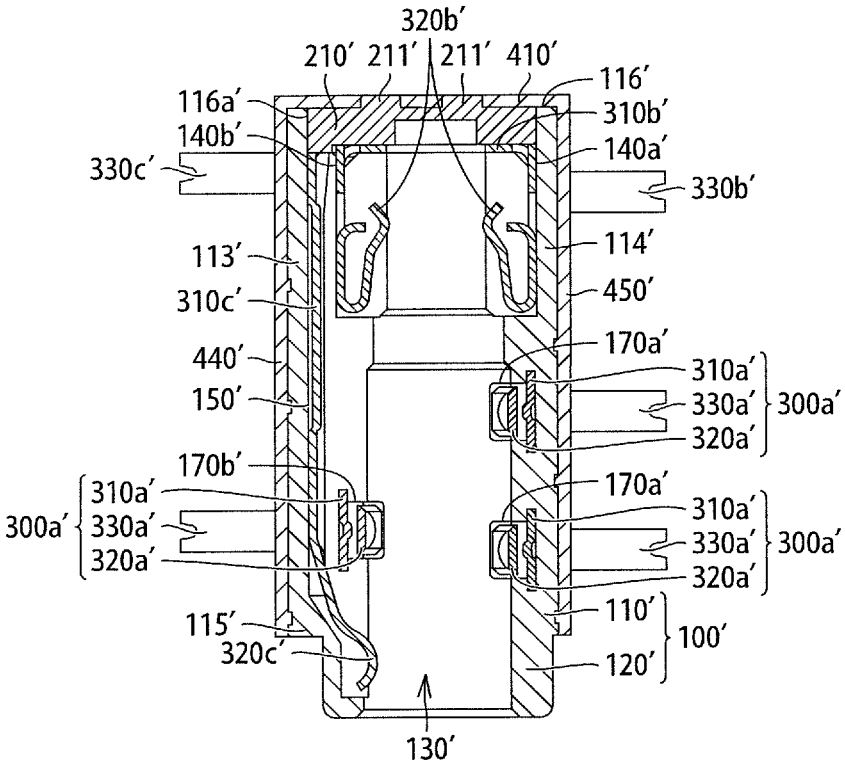
FIG. 5C is a sectional view of the connector taken along 5C-5C in FIG. 4A, with the gasket removed.
Figure 5D:
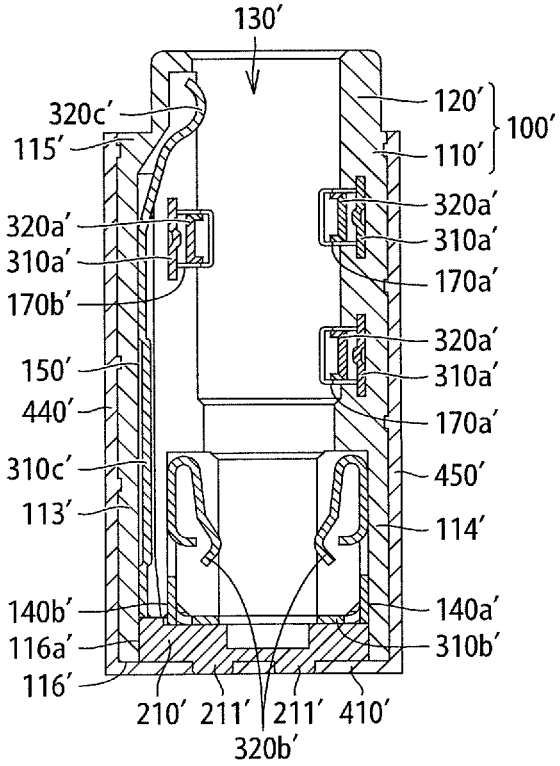
FIG. 5D is a sectional view of the connector taken along 5D-5D in FIG. 4A, with the gasket removed.
Figure 6A:
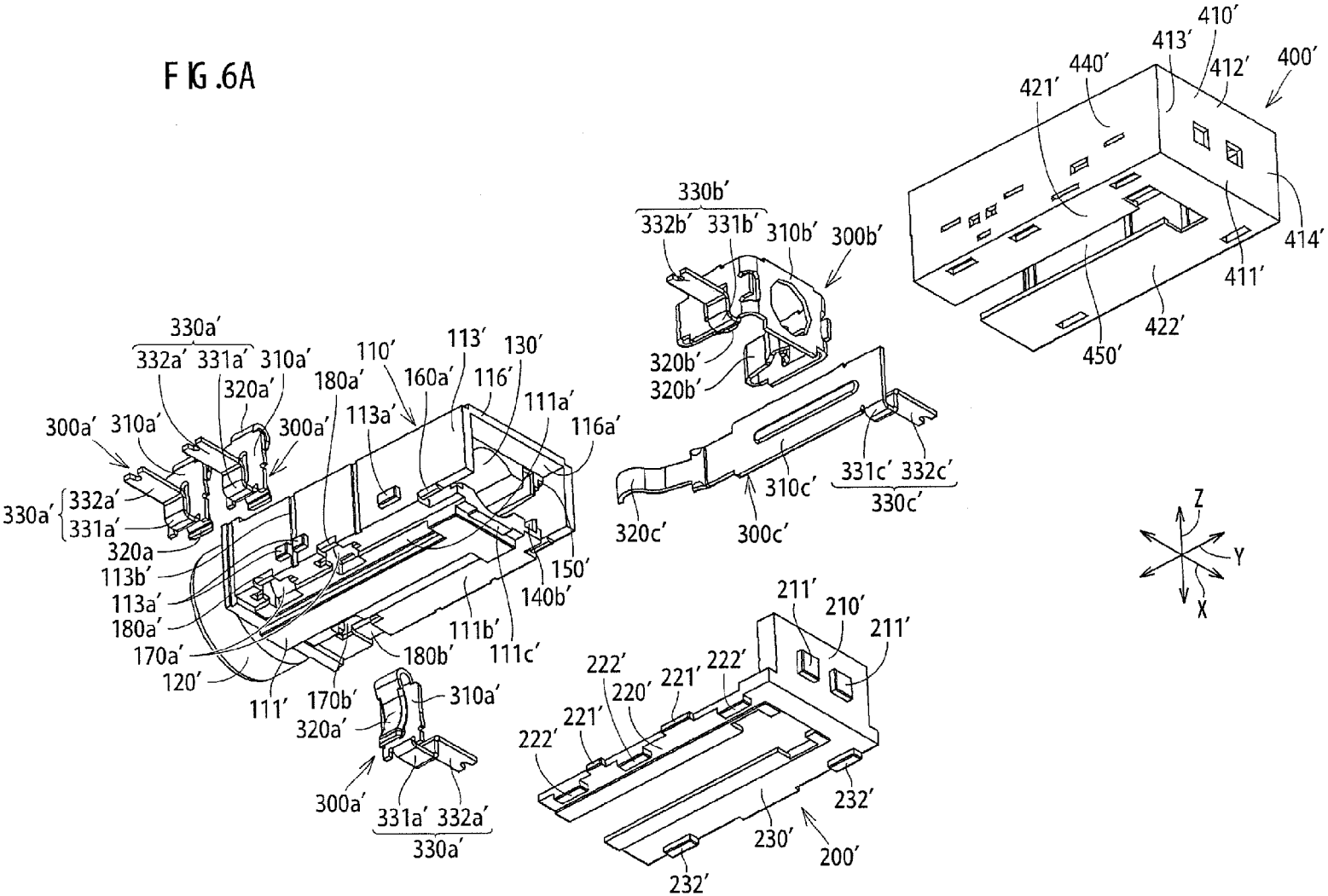
FIG. 6A is an exploded, back, bottom, right side perspective view of the connector.
Figure 6B:
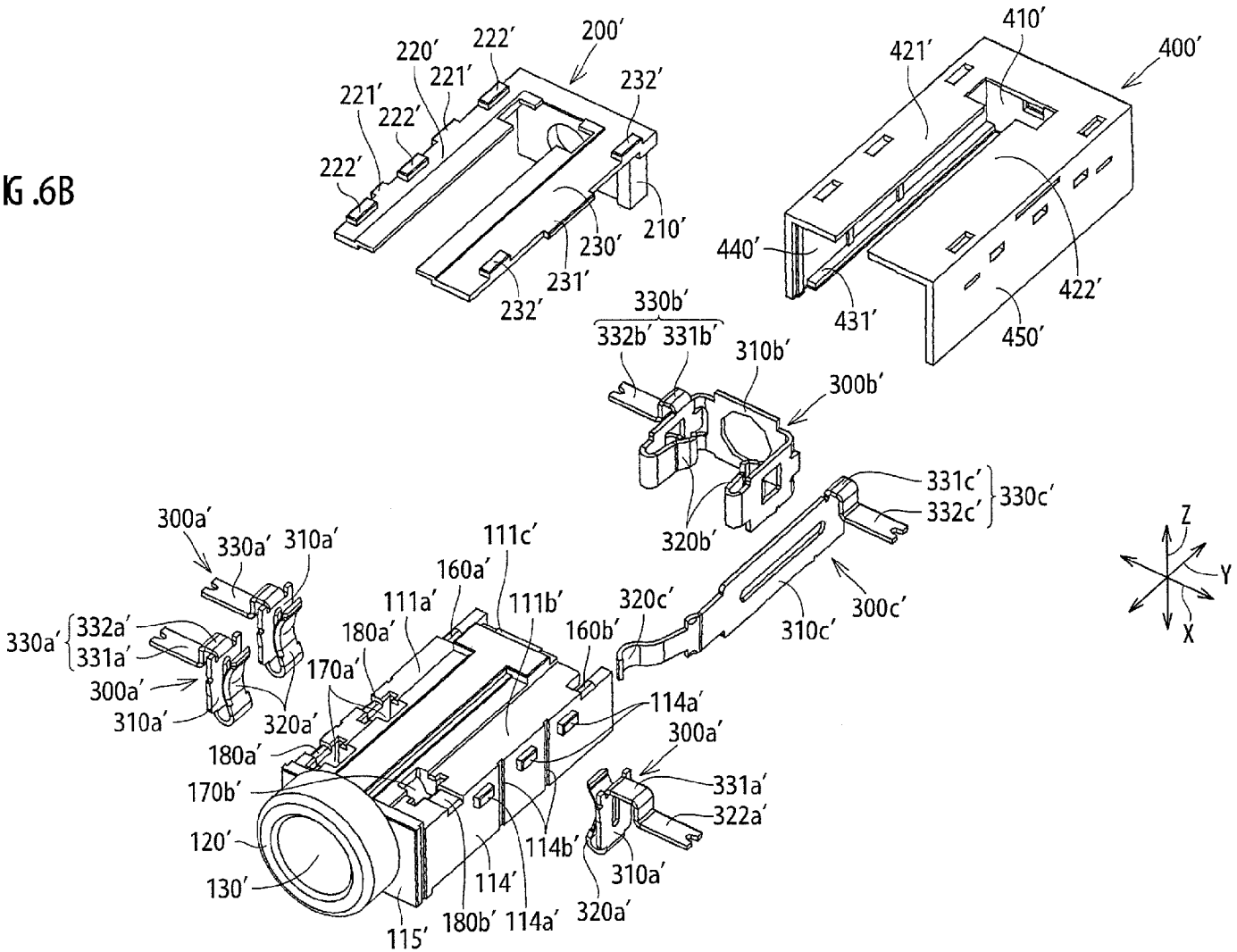
FIG. 6B is an exploded, front, bottom, left side perspective view of the connector.

The cover 200' has substantially the same configuration as the cover 200 except for the following differences. Particularly, a first blocking portion 210' is provided with a plurality of protrusions 211', a second blocking portion 220' is provided with a plurality of protrusions 221', 222', and a second blocking portion 230' is provided with a plurality of protrusions 231', 232'. As shown in FIG. 4C, a gap S1' is provided between the other end face in the X direction of the second blocking portion 220' and the inner wall on the other side in the X direction of the first recess 111*a'* of the main body 110'. As shown in FIG. 4D, a gap S2' is provided between the one end surface in the X direction of the second blocking portion 230' and the inner wall on the one side in the X direction of the first recess 111*b'* of the main body 110'. As shown in FIG. 1D, a gap S3' is provided between the integrated basal end of the second blocking portions 220', 230' and the inner wall on other side in the Y direction of the recess 111*c'* of the main body 110'.

The contacts 300*a'* are different from the contacts 300*a* in that the connecting portions 330*a'* are bent upward in the generally L-shape. The connecting portions 330*a'* each include a basal end 331*a'* and a distal end 332*a'*. The basal end 331*a'* is continuous with the other end in the Z direction of a fixed portion 310*a'* and is bent toward one end in the Z direction. The basal end 331*a'* passes through the lead holes 180*a'*, 180*b'* of the main body 110' and protrudes toward the third ends 113', 114' of the main body 110'. The distal end 332*a'* is continuous with the basal end 331*a'* and is bent substantially perpendicularly to the basal end 331*a'*. The distal end 332*a'* passes through fourth and fifth molded portions 440', 450' of the molded portion 400'. FIG. 4A to FIG. 6B also illustrate contact portions 320*a'*.

The contact 300*b'* is different from the contact 300*b* in that a connecting portion 330*b'* is bent upward in generally L-shape. The connecting portion 330*b'* includes a basal end 331*b'* and a distal end 332*b'*. The basal end 331*b'* is continuous with the other end in the Z direction of the fixed portion 310*b'* and is folded toward the one end in the Z direction. The basal end 331*b'* passes through the lead hole 160*a'* of the main body 110' and protrudes toward the third end 113' of the main body 110'. The distal end 332*b'* is continuous with the basal end 331*b'* and bent substantially perpendicularly to the basal end 331*b'*. The distal end 332*b'* passes through the fourth molded portion 440' of the molded portion 400'. FIG. 4A to FIG. 6B also illustrate contact portions 320*b'*.

The contact 300*c'* is different from the contact 300*c* in that a connecting portion 330*c'* is bent upward in generally L-shape. The connecting portion 330*c'* includes a basal end 331*c'* and a distal end 332*c'*. The basal end 331*c'* is continuous with the other end in the Z direction of the fixed portion 310*c'* and is folded toward the one end in the Z direction. The basal end 331*c'* passes through the lead hole 160*b'* of the main body 110' and protrudes toward the fourth end 114' of the main body 110'. The distal end 332*c'* is continuous with the basal end 331*c'* and is bent substantially perpendicularly to the basal end 331*c'*. The distal end 332*c'* passes through the fifth molded portion 450' of the molded portion 400'. FIG. 4A to FIG. 6B also illustrate a contact portion 320*c'*.

The molded portion 400' has substantially the same configuration as the molded portion 400 except for the following two points. The first difference is that the protrusions 211' are embedded in the first molded portion 410', the protrusions 222', 232' are embedded in the second molded portions 421', 422', the protrusions 221' are embedded in the fourth molded portion 440', and the protrusion 231' is embedded in the fifth molded portion 450'. The second difference is that the fourth molded portion 440' is filled in the grooves 113*b'*, and the fifth molded portion 450' is filled in the grooves 113*b'*. FIG. 4A to FIG. 6B also illustrate third molded portions 431', 432'.

The connector with the above-mentioned configuration may be assembled in a similar manner as in Embodiment 1. The assembled connector may be mounted on a circuit board of an electronic device in the following steps. First, the connector is placed in a recess or a hole of the circuit board. Then, the distal ends 332*a'* of the connecting portions 330*a'* of the contacts 300*a'* each contact an electrode on an edge of the recess or hole of the circuit board. The distal end 332*b'* of the connecting portion 330*b'* of the contact 300*b'* contacts another electrode on the edge of the recess or hole of the circuit board. The distal end 332*c'* of the connecting portion 330*c'* of the contact 300*c'* contacts an earth electrode on the edge of the recess or hole of the circuit board. After that, the distal ends 332*a'* of the connecting portions 330*a'* of the contacts 300*a'* are soldered to the electrodes on the circuit board. The distal end 332*b'* of the connecting portion 330*b'* of the contact 300*b'* is soldered to the another electrode on the circuit board. The distal end 332*c'* of the connecting portion 330*c'* of the contact 300*c'* is soldered to the earth electrode on the circuit board.

The connector may be connected to a plug in the following steps. First, the plug is inserted into the connecting hole 130' of the connector. Then, the third electrode of the plug is elastically held between the contact portions 320*b*' of the contact 300*b*'. The second electrode of the plug elastically contacts the contact portion 320*a*' of one of the three contacts 300*a*'. The first electrode of the plug is elastically held between the contact portion 320*a*' of the remaining two contacts 300*a*'. The earth electrode of the plug elastically contacts the contact portions 320*b*' of the contact 300*b*'.

The above-described connector has many advantageous features. First, the first molded portion 410' covers and blocks the boundary between the sixth end 116' of the main body 110' and the first blocking portion 210' of the cover 200'. The second molded portions 421', 422' cover and block the boundaries between the second blocking portions 220', 230' and the first end 111' of the main body 110'. The fourth molded portion 440' covers and blocks the boundary between the second blocking portion 220' and the third end 113' of the main body 110', the boundaries between the connecting portions 330*a*' of the contacts 300*a*' and the second blocking portion 220', the boundaries between the connecting portions 330*a*' of the contacts 300*a*' and the third end 113' of the main body 110', the boundary between the connecting portion 330*b*' of the contact 300*b*' and the second blocking portion 220', and the boundary between the connecting portion 330*b*' of the contact 300*b*' and the third end 113' of the main body 110'. The fifth molded portion 450' covers and blocks the boundary between the second blocking portion 230' and the fourth end 114' of the main body 110', the boundary between the connecting portion 330*a*' of the contact 300*a*' and the second blocking portion 230', the boundary between the connecting portion 330*a*' of the contact 300*a*' and the fourth end 114' of the main body 110', the boundary between the connecting portion 330*c*' of the contact 300*c*' and the second blocking portion 230', and the boundary between the connecting portion 330*c*' of the contact 300*c*' and the fourth end 114' of the main body 110'. The connector is thus capable of preventing water intrusion from between the cover 200' and the body 100', between the body 100' and the connecting portions 330*a*', 330*b*', 330*c*' of the contacts 300*a*', 300*b*', 300*c*', and between the cover 200' and the connecting portion 330*a*', 330*b*', 330*c*' of the contacts 300*a*', 300*b*', 300*c*'. Moreover, the connector can provide such waterproof property at low costs because the first molded portion 410', the second molded portions 421', 422', and the fourth and fifth molded portions 440', 450' are manufactured by outsert molding or in a similar method.

Further advantageously, the second molded portions 421', 422' are filled in the first recesses 111*a*', 111*b*' and the recess 111*c*' of the main body 110' to cover the second blocking portions 220', 230', and the third molded portions 431', 432' are filled in the second recesses 112*a*', 112*b*' of the main body 110'. Similarly, the fourth molded portion 440' covers the third end 113' of the body 100' and the one side in the X direction of the second blocking portion 220', and the fifth molded portion 450' covers the fourth end 114' of the body 100' and the other side in the X direction of the second blocking portion 230'. In other words, the second molded portions 421', 422' and the third molded portions 431', 432' hold the body 100' and the cover 200' therebetween in the Z direction, and the fourth and fifth molded portions 440', 450' hold the body 100' and the cover 200' in the X direction. As a result, the molded portion 400' provides an advantageously high bonding strength with respect to the cover 200' and the body 100'.

Still further advantageously, the protrusions 211' of the first blocking portion 210' are embedded in the first molded portion 410', the protrusions 222', 232' of the second blocking portion 220', 230' are embedded in the second molded portion 421', 422', the protrusions 221' of the second blocking portion 220' are embedded in the fourth molded portion 440', and the protrusion 231' of the second blocking portion 230' is embedded in the fifth molded portion 450'. The fourth and fifth molded portions 440', 450' are filled in the grooves 113*b*', 114*b*' of the main body 110'. These features of the molded portion 400' also contribute to an advantageously high bonding strength with respect to the cover 200' and the body 100'.

The connectors of the invention are not limited to ones in accordance with the above-mentioned embodiments. They may be modified in design in any manner within the scope of the claims. Specific modifications will be described in detail below.

The body may include the connecting hole, the plurality of housing holes, the plurality of slits, and the housing recess as in Embodiments 1 and 2. However, the body may be modified in any manner as long as the body includes a connecting hole, and a housing hole or slit that communicates with the connecting hole and is open to the outside of the body. For example, the slit may be provided in the bottom of the first recess of the first end of the body. Alternatively, the body may be provided with housing holes on one side or both sides in the X direction of the connecting hole of the body.

The connecting hole may pass through the main body and the ring in the Y direction as in Embodiments 1 and 2. The connecting hole may be of any shape if provided in the body and adapted to detachably receive a mating connector.

The main body may be provided with the lead holes communicating with the housing hole and the slit as in Embodiments 1 and 2. The lead holes may be omitted. If omitted, the connecting portions of the contacts may protrude from a gap or gaps between the body and the cover to the outside of the body and the cover. Alternatively, there may be at least one lead hole provided in at least one of the body and the cover to connect the housing hole or slit to the outside of the body and the cover. Specifically, the cover may have at least one lead hole, or the cover and the body may each have at least one lead hole.

The first end of the body may be provided with the two first recesses as in Embodiments 1 and 2. The first recesses may be omitted. Particularly, the first end of the body may have housing holes or slits in place of the first recesses. Alternatively, the first end of the body may be provided with one first recess or three or more first recesses.

The second end of the body may be provided with the two second recesses as in Embodiments 1 and 2. The second recesses may be omitted. Particularly, the second end of the body may have housing holes or slits in place of the first recesses. Alternatively, the second end of the body may be provided with one second recess or three or more second recesses.

The cover may include the first blocking portion and the two second blocking portions as in Embodiments 1 and 2. Alternatively, the cover may be modified as long as it can block the housing hole or slit of the body. For example, the cover may have only the first blocking portion if the bodies 100, 100' are provided with the connecting holes 130, 130' and the slits 140*a*, 140*b*, 140*a*', 140*b*' only. the cover may have only the second blocking portions if the bodies 100, 100' are provided with the connecting holes 130, 130' and the housing holes 170*a*, 170*a*' only. Alternatively, the cover may be provided with a single second blocking portion to cover the lead holes 160*a*, 160*b*, the housing holes 170*a*, 170*b* and the lead holes 180*a*, 180*b* of the first end 111 of the body 100, or to cover the lead hole 160*a*', 160*b*', the housing holes 170*a*', 170*b*' and the lead holes 180*a*', 180*b*' of the first end 111' of the body 100'.

Figure 7:
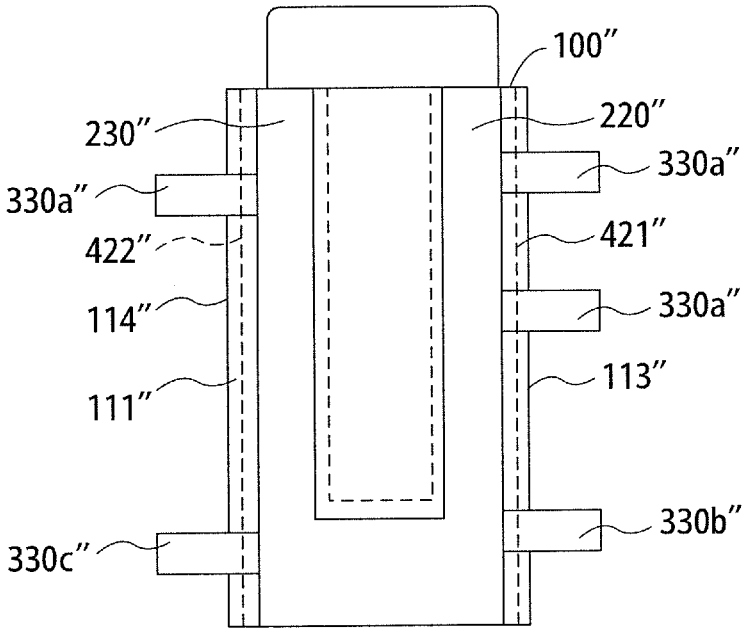
FIG. 7 is a schematic bottom view of a modification example of the connector of Embodiment 1.

The invention is not limited to the arrangement of Embodiments 1 and 2 where the one end surface in the X direction of the second blocking portion is flush with the end surface of the third end of the main body, and where the other end surface in the X direction of the second blocking portion is flush with the end surface of the fourth end of the main body. For example, the cover and the molded portion may be modified as shown in FIG. 7. More particularly, the end surface on the one side in the X direction of the second blocking portion 220" is located closer to the other side in the X direction than the end surface of a third end 113" of the body 100", and the end surface on the other side in the X direction of the second blocking portion 230" is located closer to the one side in the X direction than the end surface of a fourth end 114" of the body 100".

In this case, the following boundaries are all on the same plane of a first end 111" of the body 100"—namely, the boundaries between end surfaces on one and the other sides in the X direction of the second blocking portions 220", 230" and the body 100", the boundaries between the second blocking portion 220" and connecting portions 330*a*", 330*b*" of contacts, the boundaries between the body 100" and the connecting portions 330*a*", 330*b*" of the contacts, the boundaries between the second blocking portion 230" and the connecting portions 330*a*", 330*c*" of the contacts, and the boundaries between the body 100" and the connecting portions 330*a*", 330*c*" of the contacts. A second molded portion 421" covers the second blocking portion 220" and bonds the second blocking portion 220" to the first end 111" of the body 100". The connecting portions 330*a*", 330*b*" pass through the second molded portion 421". In other words, the second molded portion 421" covers and blocks the boundary between the end surface on the one side in the X direction of the second blocking portion 220" and the first end 111" of the body 100", the boundary between the end surface on the other side in the X direction of the second blocking portion 220" and the first end 111" of the body 100", the boundaries between the second blocking portion 220" and the connecting portions 330*a*", 330*b*" of the contacts, and the boundaries between the first end 111" of the body 100" and the connecting portions 330*a*", 330*b*" of the contacts. Another second molded portion 422" covers the second blocking portion 230" and bonds the second blocking portion 230" to the first end 111" of the body 100". The connecting portions 330*a*", 330*c*" pass through the second molded portion 422". In other words, the second molded portion 422" covers and blocks the boundary between the end surface on the one side in the X direction of the second blocking portion 230" and the first end 111" of the body 100", the boundary between the end surface on the other side in the X direction of the second blocking portion 230" and the first end 111" of the body 100", the boundaries between the second blocking portion 230" and the connecting portions 330*a*", 330*c*" of the contacts, and the boundaries between the first end 111" of the body 100" and the connecting portions 330*a*", 330*c*" of the contacts. In this case, the fourth and fifth molded portions may be omitted.

The main body and the cover may be modified such that only the one end surface in the X direction of the second blocking portion and the end surface of the third end of the main body are flush with each other. Alternative modification is that only the other end surface in the X direction of the second blocking portion and the end surface of the fourth end of the main body are flush with each other.

The molded portion may include the first molded portion, the two second molded portion, the two third molded portions, the fourth molded portion and the fifth molded portion as in Embodiments 1 and 2. The molded portion may be modified in any manner as long as it is an element of insulating resin adapted to cover at least a boundary between the body and the cover, a boundary between the body and the connecting portion of the contact, and a boundary between the cover and the connecting portion of the contact. For example, the molded portion may include a first molded portion having a first end in the Z direction and a second end in the Z direction on the opposite side from the first end, a second molded portion communicating with the first end of the first molded portion, and a third molded portion communicating with the second end of the first molded portion. In this case, the first molded portion may cover the first blocking portion blocking one side of the connecting hole passing through the body and bond the first blocking portion to the body. The second molded portion may be filled in the first recess of the first end of the body, cover the second blocking portion blocking the housing hole or slit in the bottom of the first recess, and bond the second blocking portion to the body. The third molded portion may be filled in the second recess of the body. In the case where the first end of the body is provided with the housing holes or the like in place of the first and second recesses, the second and third molded portions may be modified to cover the first and second ends, respectively, of the body.

The outer surface of the body may be provided with the protrusions and the grooves and the outer surface of the cover may be provided with the protrusions as in Embodiment 2. The invention is not limited to this configuration, and the protrusions and the grooves may be omitted as in Embodiment 1. The protrusions and/or the grooves may be provided only in the outer surface of the body, or alternatively only in the outer surface of the cover. The protrusions may be modified in any manner as long as the protrusions are embedded in the molded portion. The grooves may be modified in any manner as long as the molded portion is filled in the grooves.

The above-mentioned embodiments and modification examples are described by way of examples only. The materials, shapes, sizes, numbers and arrangements of the elements of the connectors of the invention may be modified as long as they can perform the same functions.

REFERENCE SIGNS LIST

100 body
110 main body
111 first end
111*a* first recess
111*b* first recess
112 second end
112*a* second recess
112*b* second recess
113 third end
114 fourth end
115 fifth end
116 sixth end
120 ring
130 connecting hole
140*a* slit
140*b* slit
150 slit
160*a* lead hole
160*b* lead hole
170*a* housing hole
170*b* housing hole
180*a* lead hole
180*b* lead hole
200 cover

210 first blocking portion
220 second blocking portion
230 second blocking portion
300*a* contact
310*a* fixed portion
320*a* contact portion
330*a* connecting portion
331*a* basal end
332*a* distal end
300*b* contact
310*b* fixed portion
320*b* contact portion
330*b* connecting portion
331*b* basal end
332*b* distal end
300*c* contact
310*c* fixed portion
320*c* contact portion
330*c* connecting portion
331*c* basal end
332*c* distal end
400 molded portion
410 first molded portion
421 second molded portion
422 second molded portion
431 third molded portion
432 third molded portion
440 fourth molded portion
450 fifth molded portion
500 gasket

The invention claimed is:

1. A connector comprising:
a body including:
a connecting hole, and
a housing hole or slit communicating with the connecting hole and being open to an outside of the body;
a cover to block the housing hole or slit of the body;
a contact including:
a fixed portion fixedly attached in the housing hole or slit of the body,
a contact portion disposed in the connecting hole, and
a connecting portion protruding from between the body and the cover to an outside of the body and the cover; and
a molded portion of insulating resin to cover and block at least a boundary between the body and the cover, a boundary between the body and the connecting portion of the contact, and a boundary between the cover and the connecting portion of the contact.

2. The connector according to claim 1, wherein
the connecting hole passes through the body in a first direction,
the body further includes:
a first end in a second direction orthogonal to the first direction,
a second end in the second direction on the opposite side from the first end,
a first recess provided in the first end, the first recess having a bottom provided with the housing hole or slit, and
a second recess provided in the second end,
the cover includes:
a first blocking portion to block the connecting hole, and
a second blocking portion housed in the first recess so as to block the housing hole or slit, and
the molded portion includes:
a first molded portion covering the first blocking portion and bonding the first blocking portion to the body, the first molded portion including a first end in the second direction and a second end in the second direction on the opposite side from the first end,
a second molded portion being continuous with the first end of the first molded portion and filled in the first recess of the body, the second molded portion covering the second blocking portion and bonding the second blocking portion to the body, and
a third molded portion being continuous with the second end of the first molded portion and filled in the second recess of the body.

3. The connector according to claim 2, wherein
the body further includes:
a third end in a third direction orthogonal to the first and second directions, and
a fourth end in the third direction on the opposite side from the third end,
the first molded portion further includes:
a third end in the third direction, and
a fourth end in the third direction on the opposite side from the third end, and
the molded portion further includes:
a fourth molded portion continuous with the third end of the first molded portion, the fourth molded portion covering the third end of the body, and
a fifth molded portion continuous with the fourth end of the first molded portion, and the fifth molded portion covering the fourth end of the body.

4. The connector according to claim 3, wherein
one end surface in the third direction of the second blocking portion is flush with an end surface of the third end of the body, and
the fourth molded portion bonds the end surface of the second block portion to the end surface of the third end of the body.

5. The connector according to claim 3, wherein
the other end surface in the third direction of the second blocking portion is flush with an end surface of the fourth end of the body, and
the fifth molded portion bonds the end surface of the second block portion to the end surface of the fourth end of the body.

6. The connector according to claim 2, wherein
the connecting portion of the contact passes through the second molded portion.

7. The connector according to claim 3, wherein
the connecting portion of the contact passes through the fourth or fifth molded portion.

8. The connector according to claim 1, wherein
at least one of the body and the cover is provided with a lead hole for interconnecting between the housing hole or slit and the outside of the body and the cover, and
the connecting portion of the contact protrudes through the lead hole to the outside of the body and the cover.

9. The connector according to claim 1, wherein
at least one of the body, the cover and the molded portion is made of a polyamide resin.

10. The connector according to claim 1, further comprising a ring-shaped gasket to fit around the body.

11. An electronic device comprising the connector according to claim 1.

* * * * *